US010044083B2

(12) United States Patent
Haeussler et al.

(10) Patent No.: US 10,044,083 B2
(45) Date of Patent: Aug. 7, 2018

(54) DUAL-CHANNEL POLARIZATION CORRECTION

(71) Applicant: Lisa Draexlmaier GmbH, Vilsbiburg (DE)

(72) Inventors: Christoph Haeussler, Reutlingen (DE); Thomas Merk, Stuttgart (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 78 days.

(21) Appl. No.: 15/161,011

(22) Filed: May 20, 2016

(65) Prior Publication Data

US 2016/0344083 A1 Nov. 24, 2016

(30) Foreign Application Priority Data

May 22, 2015 (DE) ..... 10 2015 108 154

(51) Int. Cl.
*H01P 1/17* (2006.01)

(52) U.S. Cl.
CPC ..... *H01P 1/171* (2013.01)

(58) Field of Classification Search
CPC ..... H01P 1/17; H01P 1/171; H01P 1/165
USPC ..... 333/21 A
See application file for complete search history.

(56) References Cited

U.S. PATENT DOCUMENTS

| | | | | |
|---|---|---|---|---|
| 6,097,264 | A | 8/2000 | Vezmar | |
| 2011/0057849 | A1* | 3/2011 | Naym | H01P 1/161 343/756 |
| 2012/0319799 | A1* | 12/2012 | Wolf | H01P 1/161 333/137 |

FOREIGN PATENT DOCUMENTS

| | | |
|---|---|---|
| DE | 20 2009 006 651 U1 | 7/2009 |
| DE | 10 2014 113 813 A1 | 3/2016 |
| EP | 2 425 490 B1 | 3/2012 |

OTHER PUBLICATIONS

G4UHP, Circular and Rectangular Waveguide Septum Transformer Feeds, 2014, URL: https://web.archive.org/web/20140326113551/http://g4hup.com/Personal/septum.html.

* cited by examiner

*Primary Examiner* — Robert J Pascal
*Assistant Examiner* — Kimberly Glenn
(74) *Attorney, Agent, or Firm* — Finnegan, Henderson, Farabow, Garrett & Dunner LLP

(57) ABSTRACT

Embodiments relate to a device for correcting the polarization twist of two linearly polarized signals using two polarization converters connected in series, wherein the second polarization converter can be rotated about an axis. In this way, the skew angle of an antenna can be compensated with respect to a satellite using a rotatable waveguide circuit. By converting the polarization from linear to circular, it is easier to rotate the now circularly polarized signals, using a second polarization converter, which reestablishes a linear polarization for the circularly polarized signals. Given the dual-channel signal outcoupling, the PCU may allow two orthogonal linear polarizations to be corrected at the same time using a simpler mechanical composition.

20 Claims, 6 Drawing Sheets

DUAL-CHANNEL POLARIZATION CORRECTION

CROSS REFERENCE TO RELATED APPLICATION

This application is based upon and claims the benefit of prior German Patent Application No. 10 2015 108 154.7, filed on May 22, 2015, the entire contents of which are incorporated herein by reference.

TECHNICAL FIELD

The present disclosure relates to a device for correcting the polarization shift of two linearly polarized signals using multiple polarization conversions, and may be used for mobile communication between airplanes and satellites.

BACKGROUND OF THE DISCLOSURE

Wireless broadband channels are necessary for transmitting multimedia data from a satellite network to moving vehicles, such as airplanes. For this purpose, antennas must be installed on the vehicles and require small dimensions to enable installation beneath a radome, while satisfying the requirements of the sending characteristics for directional wireless data communication with the satellite (such as in the Ku, Ka or X band), since interference with neighboring satellites must be reliably precluded.

When vehicles are moving, the relative position of the antenna with respect to the satellite changes continuously, so that constant tracking of the orientation of the antenna is required. The antenna is movable beneath the radome for this purpose to track the orientation at the satellite when the airplane is moving.

It is not only necessary to set the orientation of the antenna at the satellite, but also to compensate for polarization shifts of a received signal. The polarization shifts result from the changes in the vehicle's geographic position relative to the satellite and the angle of inclination of the vehicle-based antenna.

Bidirectional antenna systems for mobile satellite communication differ in the manner of the polarization thereof, among other things. For example, a distinction is made between linear and circular polarization, based on the satellite service. The polarization, in general, describes the orientation of the field lines in the plane orthogonal to the main lobe of the antenna. In the case of linear polarization, the field lines are always linearly oriented, and usually two orthogonal polarizations (horizontal and vertical) are used. In the case of circular polarization, the field lines follow a circular movement in the plane perpendicular to the main lobe. In this respect, a distinction is made between left hand (LHCP) and right hand (RHCP).

For satellite services using linear polarization, it is important that the planes of polarization of the antenna are correctly aligned with those of the satellite signal. Undesirable shifts in the planes of polarization result in polarization losses, signal interference, violation of regulatory requirements, and the like.

Shifts in the planes of polarization of the antenna and the satellite may be caused by a variety of effects such as limited mobility of the antenna positioning system, geographical location relative to the satellite, or movements of the vehicle. These may be corrected/compensated for by a polarization control unit (PCU), which pre-rotates the received signals, or the signals to be transmitted, corresponding to the present skew angle.

In many applications, 2-axes positioning systems are used. These systems can be used for the independent azimuth and elevation rotation of the antenna. The two axes of these systems form an orthogonal system and may allow the antenna to be aligned with any arbitrary point in the upper hemisphere of the three-dimensional space.

The 2-axes positioning systems, however, include a variety of drawbacks. For example, if the wireless communication system operates with electro-magnetic waves having a linear polarization, upon a rotation of the antenna the planes of polarization generally also rotate, so that the polarization plane of the target antenna no longer corresponds with the plane of polarization of the antenna located on the positioning system.

EP 2 425 490 B1 discloses a skew compensation controller for an individual polarization direction, which is based on a rotatable waveguide module. The user, however, often requires the horizontally and vertically polarized signals to be provided at the same time. Coupling the high-frequency signal out of the rotating waveguide module is critical since the guidance of the signal conductors represents a limitation in the outcoupling of two signal components.

DE 10 2014 113 813 discloses a dual-channel compensation of the polarization shift, in which a waveguide section can be rotated and switched back and forth between the signals so as to limit the necessary rotational angle for a full compensation. However, this requires several additional electronic components and cannot be used to process powerful transmission signals.

DE 20 2009 006 651 U1 discloses a micro-rotating joint having a rotatable round waveguide between two square waveguides, enabling the antenna to rotate.

U.S. Pat. No. 6,097,264 A discloses quad-ridge polarizers that are easy to produce.

G4UHP Circular and Rectangular Waveguide Septum Transformer Feeds discloses incoupling options into waveguides (See G4UHP Circular and Rectangular Waveguide Septum Transformer Feeds, 2014, URL: https://web.archive.org/web/20140326113551/http://g4hup.com/Personal/septum.html).

SUMMARY

Embodiments of the present disclosure provide a dual-channel compensation of polarization shift.

In embodiments of the present disclosure, the device for correcting the polarization shift of two linearly polarized signals comprises two polarization converters connected in series, wherein the second polarization converter can be rotated about the axis thereof.

In embodiments of the present disclosure, the arrangement of the components, such as the polarizer for a linear into a circular polarization and vice versa, form a functional unit serving as a dual-channel device for correcting the polarization shift.

Embodiments of the present disclosure provide a dual channel polarization control unit (PCU), which compensates the skew angle of an antenna with respect to a satellite using a rotatable waveguide circuit. By converting the polarization from linear to circular it may be easier to rotate the now circularly polarized signals in a second polarization converter, which may reestablish a linear polarization for the circularly polarized signals. Given the dual-channel signal outcoupling, the PCU may allow two orthogonal linear polarizations to be corrected at the same time.

Embodiments of the present disclosure may require only one mechanically rotatable part (such as a second polarization converter). All incoupling and outcoupling points are fixedly connected in a static manner to conducting lines, such as coaxial conductors. As a result, coaxial or waveguide rotating joints may not be needed to connect the external signals to the PCU.

In some embodiments, the first polarization converter may be a septum polarizer. A septum polarizer is a three-pole unit that defines two physically separate connecting points and can therefore be directly connected to an antenna field, which defines two separate outputs for differently polarized signals.

According to some embodiments of the present disclosure, the septum polarizer comprises multiple restrictions that become increasingly smaller toward the second polarization converter, such that a partition that decouples the two inputs from each other is formed toward the input on the antenna side. The restrictions are used to break the linearly polarized wave into two orthogonal modes in phase quadrature. The exact dimensioning of the height and length of the restriction is provided in accordance with the desired frequency range and the bandwidth, so that the reflections remain low, and a good axial ratio is achieved for the circular wave. The restrictions may be limited to two opposing walls and may be symmetrical to each other.

According to some embodiments of the present disclosure, the septum polarizer converts antenna-side signals (H'/V') from two linear waves (TE1,0 H' and V') into two corresponding RHCP/LHCP waves. An elliptically polarized wave is obtained at a circular port of the septum polarizer, the axial ratio of which is proportional to the skew angle of the antenna. The characteristic of the elliptic wave can vary from purely LHCP (for example, skew angle=0°) through linear (skew angle=+/−45°) to purely RHCP (for example, skew angle=90°).

Due to the septum polarizer, the antenna-side portion of the PCU may have a symmetrical design, whereby no additional undesirable asymmetries are added to the two antenna polarization paths.

According to some embodiments, meander-line polarizers or quadrature couplers may be used as an alternative to the septum polarizer, which similarly cause a conversion from linear to circular polarization.

According to some embodiments of the present disclosure, the second polarization converter, which carries out a conversion of the two signals from a circular polarization into a linear polarization, may be designed as a quad-ridge polarizer.

The quad-ridge polarizer has a rotation-adapted shape and is well-suited for being rotated for a polarization shift correction, without resulting in additional reflections. The quad-ridge polarizer may be rotated in a motor-driven manner. At the output of the quad-ridge polarizer, an arbitrary elliptic wave is again broken down into the two orthogonal linear field components (TE1,0 & TE0,1).

According to some embodiments of the present disclosure, restrictions in the quad-ridge polarizer are identical on opposing walls and differ on neighboring walls, such that they have different cut-off frequencies. Due to the two different restriction pairs, a differing delay in the waves takes place for the two incoming modes, the leading wave being decelerated more strongly and thereby compensating for a shift. The number and height of the restrictions, in turn, is adapted to the frequency range and the bandwidth. While a larger number of steps create a better reflection suppression, this may be more complex to produce.

According to some embodiments of the present disclosure, the restrictions of the quad-ridge polarizer are symmetrically designed along the axis of the quad-ridge polarizer, so that the device can be operated both for transmission and reception.

According to some embodiments of the present disclosure, outcoupling elements of an outcoupling unit connected to the second polarization converter, in the zero position, are rotated 45° with respect to restrictions of the second polarization converter. The use of a quad-ridge polarizer results in a system-wide improvement in the cross-polarization separation, in particular in the case of skew angle=+/−45°. At this skew angle, the satellite signals H'/V' are distributed in equal parts among the two antenna polarization paths. In this case, any asymmetries within the antenna system may manifest themselves most strongly in the form of crosstalk between the polarizations. At this skew angle, however, the restrictions (i.e. the ridges) of the quad-ridge polarizer are located in the same plane as outcoupling elements (in the case of outcoupling into coaxial conductors, these are the coaxial coupling pins), resulting in optimal isolation between the two polarizations within the PCU.

According to some embodiments of the present disclosure, the outcoupling elements are disposed perpendicularly to each other. Furthermore, restrictions are disposed between the first and second outcoupling elements. The outcoupling element located furthest away from the second polarization converter is located approximately λ/4 away from the end of the outcoupling unit for minimal reflection. The restrictions having an orientation perpendicular to the second outcoupling element now cause the cut-off frequency for the remaining section of the outcoupling unit to be varied, and a virtual termination of the outcoupling unit to be created for the first outcoupling element, from which the first outcoupling element in turn is disposed approximately λ/4 away.

The signals can be routed again via the described dual wave-guide coaxial coupler as purely linear polarization signals H/V and can be further processed.

According to some embodiments of the present disclosure, an orthomode transducer (OMT), which causes outcoupling in waveguides, can be used if no outcoupling by way of coaxial conductors is desired.

According to some embodiments of the present disclosure, an incoupling unit connected to the first polarization converter comprises two conductors that converge toward each other, each containing incoupling elements. In this way, the two signals are separated far enough from the transition from the antenna to the PCU and are decoupled.

According to some embodiments of the present disclosure, to compensate for possible differences in the coaxial conductors to the PCU, a respective tuning screw can be disposed in the conductors of the incoupling unit on a wall located close (for example, opposite or on the same side) to the associated incoupling element. The tuning screw may be adjustable to vary the capacitance that develops between the tuning screw and the incoupling element. In this way, potential reflections are minimized.

According to some embodiments of the present disclosure, the polarization converter, incoupling unit and outcoupling unit are composed of waveguides for a low-loss composition. The waveguides have a substantially square composition so as to transmit only the desired mode, but are rounded slightly at the corners, and may be rounded more strongly in the case of the quad-ridge polarizer, to reduce a reflection between the static and rotatable parts.

According to some embodiments of the present disclosure, the device is suitable for an operation in the Ku band, for example in the frequency range from 10.7 to 12.75 GHz or from 13.75 to 14.5 GHz, for use in airplane-based systems.

DETAILED DESCRIPTION

Figure 1:
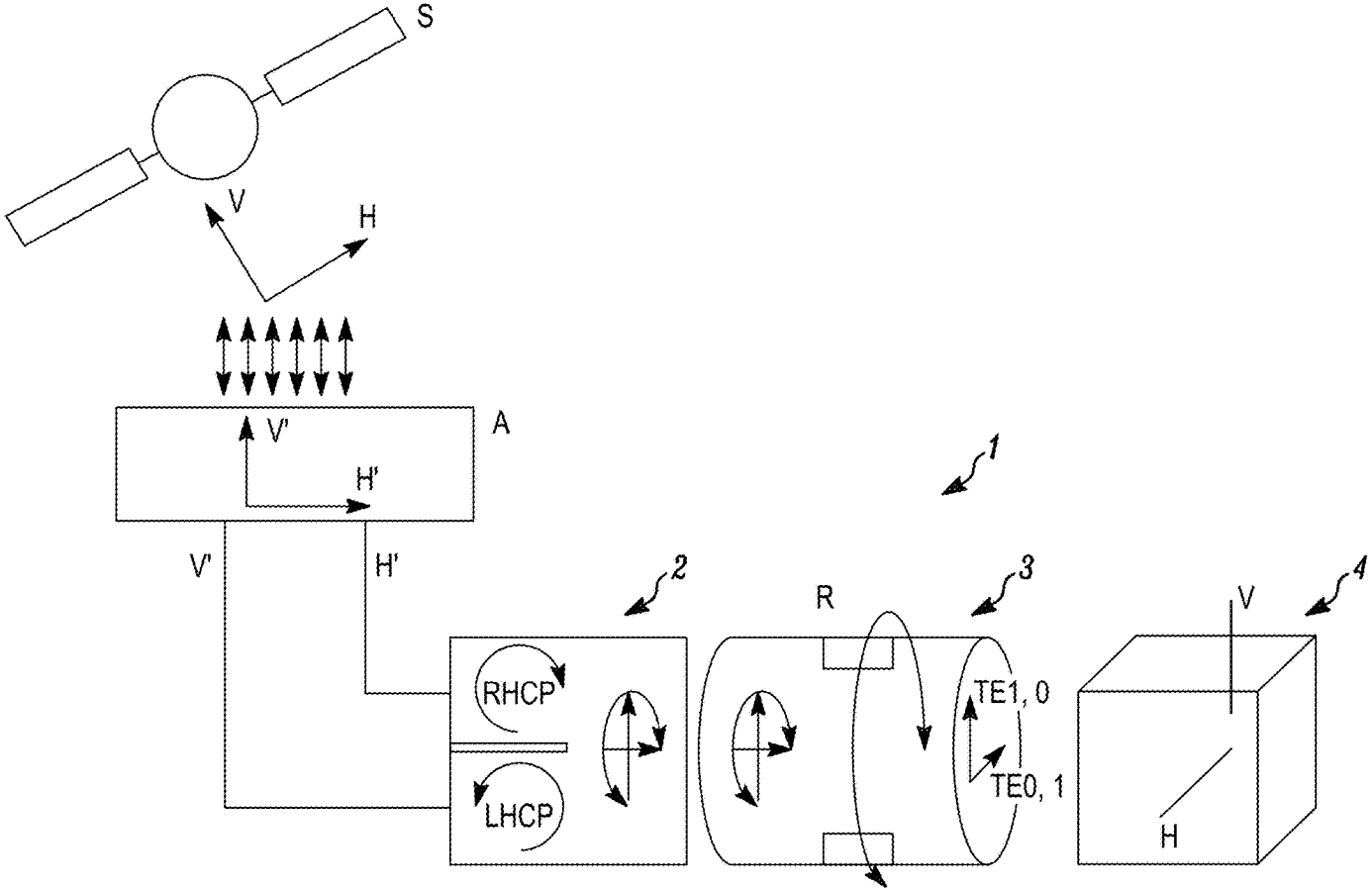
FIG. 1 shows a schematic composition of the signal transmission from a satellite to an airplane-based receiver using dual-channel polarization shift correction.

FIG. 1 shows the operating principles of an exemplary device according to the present disclosure for correcting the polarization shift of two linearly polarized signals. The device is also referred to as a dual channel polarization control unit (PCU).

The skew angle is defined as the angle between the polarization of a signal of a satellite S and of a signal at the antenna A, for example the angle between V and V' (or H and H').

Skewing the antenna A with respect to the satellite S connects the signals H/V from the antenna A as H'/V' to the PCU 1. A septum polarizer 2, serving as the first polarization converter, converts each of the two linearly polarized components H'/V' into a respective circularly polarized wave RHCP/LHCP, which differ in the sense of rotation (right-hand or left-hand). The resultant wave may be elliptically polarized at a transition to a quad-ridge polarizer 3 serving as the second polarization converter. The septum polarizer converts V' and H' into two circular waves which rotate in opposite directions. The sense of rotation of the general ellipse resulting from the superimposition of the two circular sub-waves is dependent on the amplitudes of the sub-waves. The axial ratio and the sense of rotation of the ellipse are dependent on the skew angle between the antenna A and the satellite S.

The quad-ridge polarizer 3 is not static and rotates about an axis, serving as a rotor R, in keeping with the skew angle, for example driven by a motor, and breaks the ellipse into the two linear components, which thereafter are again available as linear original signals H/V for outcoupling and further processing.

The rotation of the quad-ridge polarizer 3 is controlled by a processor (not shown) which knows the position of the airplane or other vehicle on which the antenna and the PCU are mounted, and the position of the satellite, and generates the correction signal for the rotation.

Alternatively, the signal quality may be continuously evaluated by the processor. When a signal deteriorates as a result of a polarization shift, this may be corrected by a rotation of the quad-ridge polarizer.

FIGS. 2 to 7 show an exemplary device developed for the Ku band in a frequency range from 10.7 to 12.75 GHz. The number and dimensions of the restrictions discussed in greater detail below are an exemplary compromise between an easy-to-produce mechanical composition and sufficiently good properties in terms of attenuation, reflections and polarization separation in the desired frequency band having the desired bandwidth.

Figure 2:
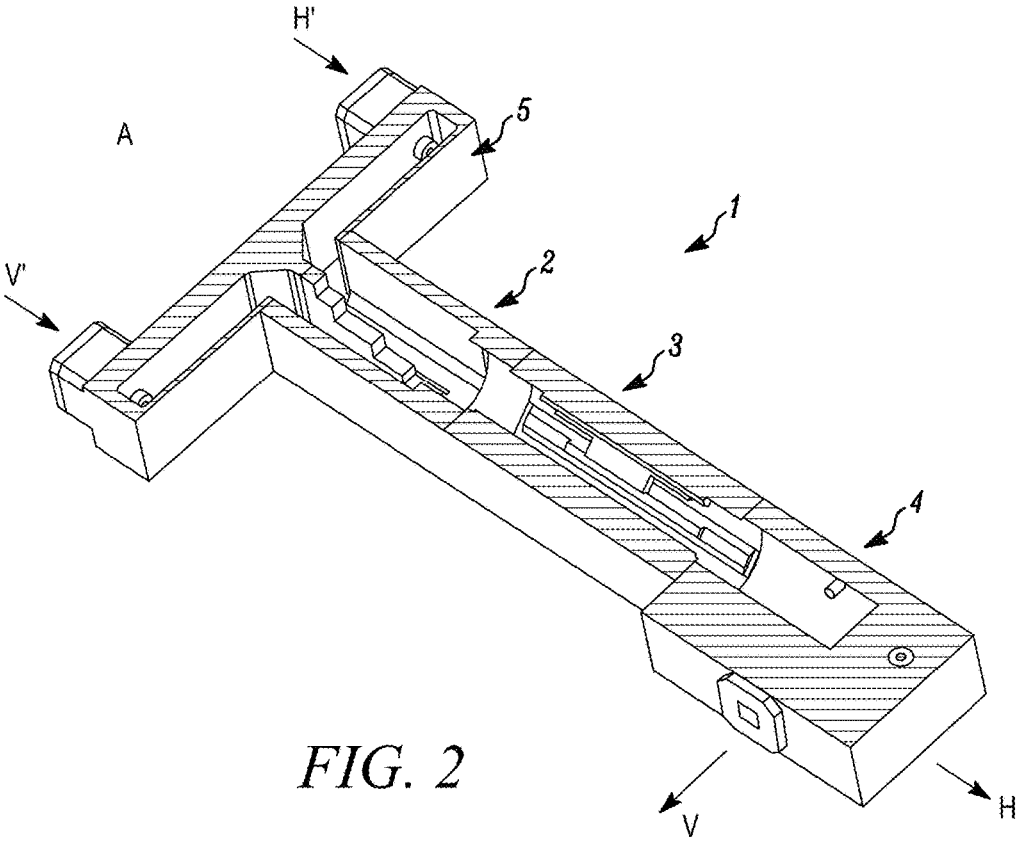
FIGS. 2 and 3 shows sectional views of the device according to an exemplary embodiment.

FIG. 2 shows a top view onto a sectional illustration of the PCU. Hereafter, the reception scenario where signals of the satellite are received by the antenna A and supplied to a receiver is shown in each case. The device can also be used for the transmission scenario so that transmission signals are appropriately corrected in advance prior to emission via the antenna A. With the exception of the incoupling and outcoupling, the device is composed of waveguides that may be generally square having rounded edges, except for the quad-ridge polarizer 3 which has a substantially cylindrical interior.

The signals V', H' arriving from the antenna A are coupled into an incoupling unit 5 by way of symmetrical coaxial wave-guide couplers and converted from a linear into a circular polarization in the septum polarizer 2. A second conversion of the circularly polarized signals into linearly polarized signals takes place in the downstream quad-ridge polarizer 3, which is connected in series, wherein a rotation of the quad-ridge polarizer 3 is used to compensate for a potential polarization shift. In an outcoupling unit 4 provided down-stream from the quad-ridge polarizer 3, the signals H/V are outcoupled by way of coaxial waveguide couplers. With the exception of the rotating quad-ridge polarizer 3, the other assemblies are static.

Figure 3:
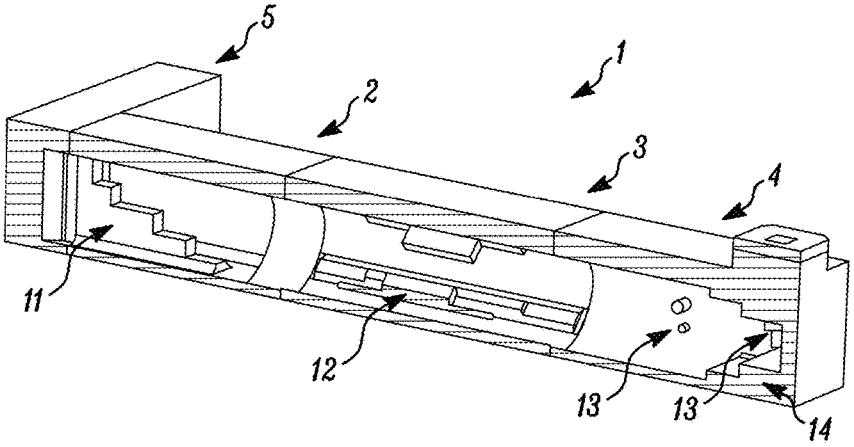

FIG. 3 shows a side view of the same exemplary device of FIG. 2. Restrictions 11, 12 and 14 in the polarizers 2, 3 and the outcoupling unit 4 are more clearly apparent, as are the outcoupling elements 13 of the outcoupling unit 4. The restrictions 11 of the septum polarizer 2 are provided downstream from a partition between the waveguides of the incoupling unit and may be located on exactly one wall. From a complete separation of the two waveguides, these restrictions 11 progress into the septum polarizer 2 in a stepped manner. In the zero position (where no polarization shift that needs compensation is present), the restrictions 12 of the quad-ridge polarizer 3 are rotated 45° in relation to the restrictions 11 of the septum polarizer 2 and the outcoupling elements 13 of the outcoupling unit 4. In the worst case of a 45° polarization shift, this minimizes crosstalk between the two channels.

The restrictions 14 of the outcoupling unit 4 may be disposed between the outcoupling points 13 and oriented perpendicularly to the outcoupling point 13 located furthest away from the quad-ridge polarizer 3. In this way, a $\lambda/4$ waveguide termination may be achieved for both outcoupling elements 13, minimizing reflections.

Figure 4:
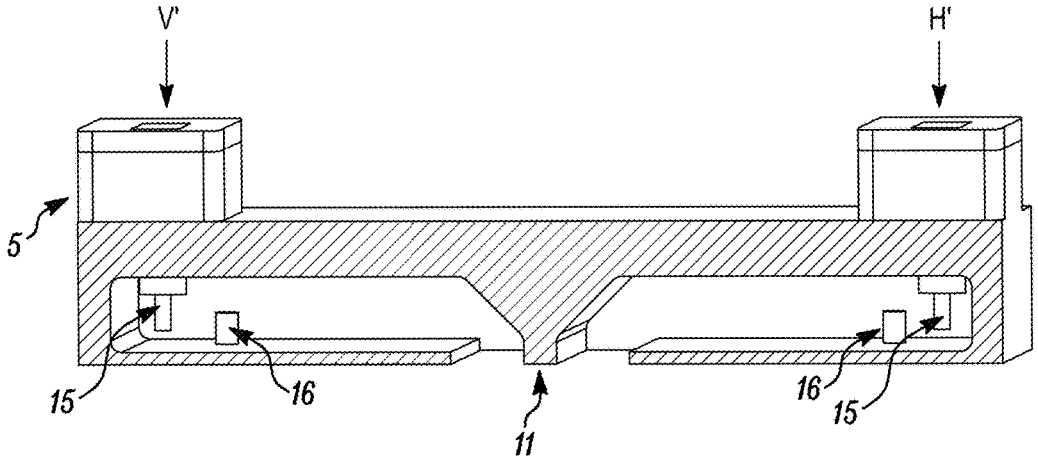
FIG. 4 shows a sectional view of an exemplary incoupling unit.

The incoupling unit 5 according to FIG. 4 shows two physically separate inputs for the antenna-side signals V', H', which are connected to the waveguide via incoupling points 15 designed as coaxial waveguide couplers. From the incoupling points 15, the waves converge toward each other in a respective rectangular waveguide, but are separated by a partition provided downstream from the restrictions 11 of the septum polarizer. The waveguide is slanted in the transition to the partition so that the two waves can enter the septum polarizer parallel to each other. Tuning screws 16 are disposed in the waveguides opposite the incoupling point 15 and between the incoupling point 15 and the partition, respectively. The penetration depth of the tuning screws 16 can be set individually by rotating them, whereby it is possible to compensate for possible reflection differences of the co-axial conductors or incoupling points 15 separately for each of the waveguides.

Figure 5:
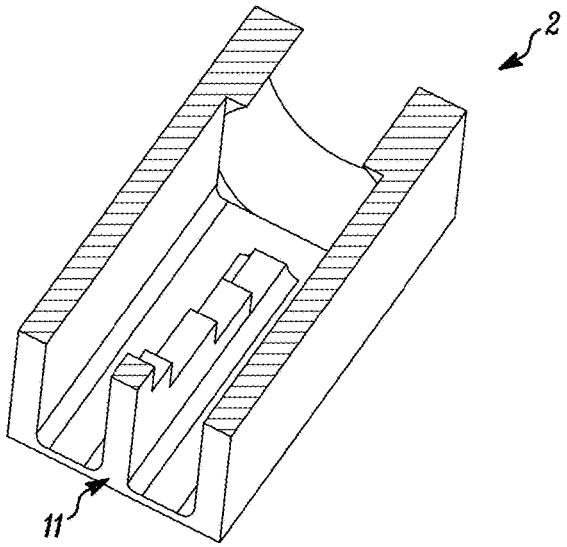
FIG. 5 shows a sectional view of an exemplary septum polarizer.

The septum polarizer 2 according to FIG. 5 includes restrictions 11 that are provided downstream from the partition of the incoupling unit. Starting from the incoupling unit—this is where the restrictions 11 separate the two halves—the restrictions 11 become increasingly smaller, until they disappear entirely in the now one-piece rectangular wave-guide. The restrictions are used to convert the linearly polarized input waves (TE 1,0 mode) into corresponding RHCP/LHCP waves having a circular polarization. Reflections in the transition to the neighboring quad-ridge polarizer are minimized by rounding the corners of the otherwise rectangular waveguide, thereby minimizing the change in cross-section toward to the more cylindrical cross-section of the quad-ridge polarizer.

Figure 6:
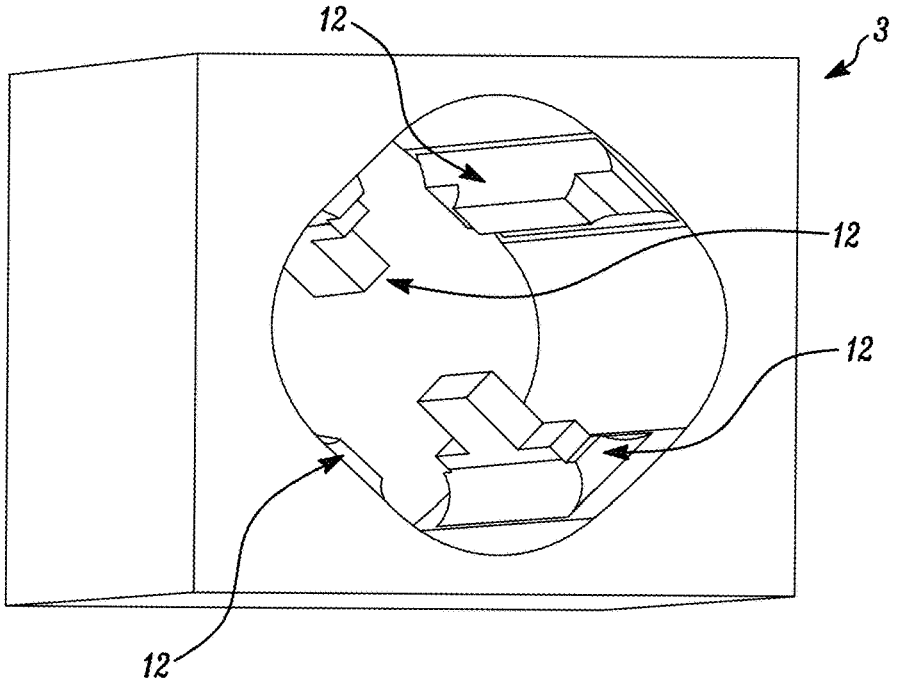
FIG. 6 shows a sectional view of an exemplary quad-ridge polarizer.

FIG. 6 shows the quad-ridge polarizer 3. The quad-ridge polarizer 3 includes two differently designed restriction pairs 12 (i.e. ridge structures) in a rounded square waveguide. The restrictions 12 break a circular input signal back into the two orthogonal linear basic components thereof by way of a 90° phase shift. In this case, TE1,0 is delayed by the more pronounced restrictions (extending further into the waveguide) with respect to TE0,1 by 90°. The restrictions 12 are symmetrical along the axis of the quad-ridge polarizer 3, so that the conversion takes place both in the reception scenario and in the transmission scenario. If restrictions 12 located opposite each other in the waveguide are identical, neighboring ones will differ from each other.

Figure 7:
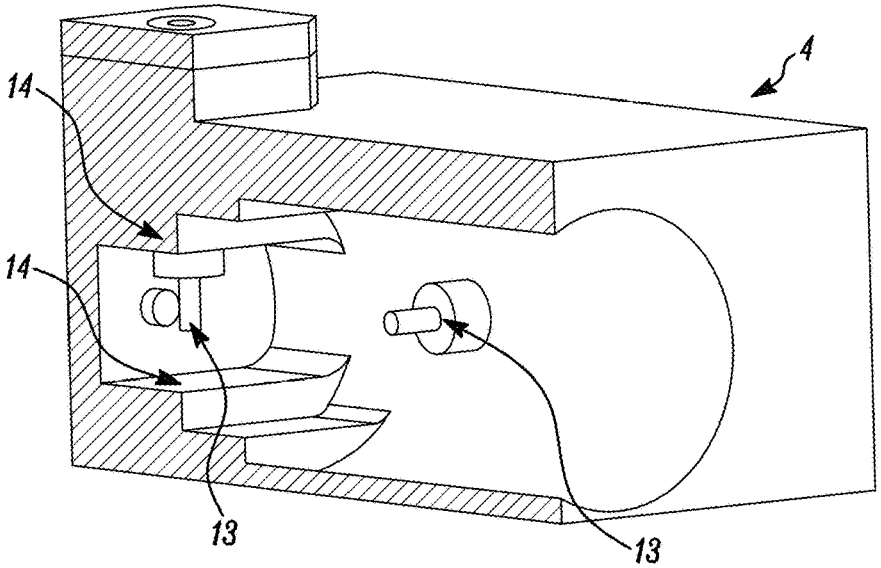
FIG. 7 shows a sectional view of an exemplary outcoupling unit.

An outcoupling unit 4 provided downstream from the quad-ridge polarizer is shown in FIG. 7. In a cylindrical round wave-guide, two outcoupling points 13 disposed perpendicularly to each other are provided as coaxial waveguide couplers. The waveguide tapers toward the end as a result of restrictions 14, which are oriented perpendicularly to the rear outcoupling element 13 and form a virtual waveguide termination for the front outcoupling element 13.

Figure 8B:
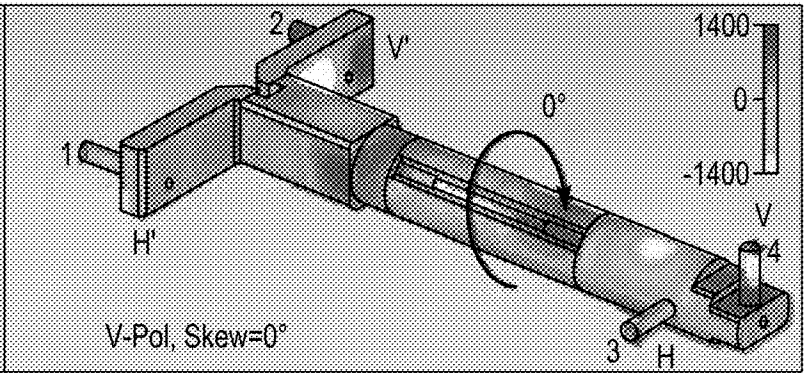
FIGS. 8*a-d* show exemplary E-field distributions at different skew angles.
Figure 8A:
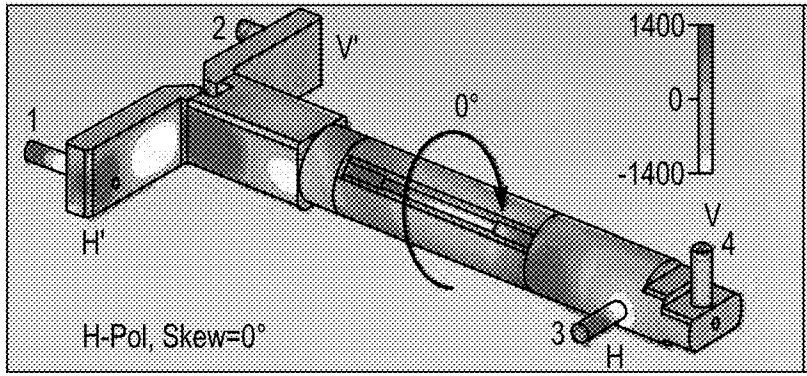

The mode of action of the PCU will be described based on exemplary polarization shifts in FIGS. 8*a-d*, wherein the E-field distribution is represented, and the ports H', V' denote the antenna-side signals and the ports H, V denote the receiver-side signals:

FIG. 8*a*, skew=0°: In this case, the planes of polarization between the satellite and the antenna are in perfect agreement (skew=0°). The satellite signal H is seen completely at the port H' by the antenna and is conducted directly to the port H. The quad-ridge polarizer is not being rotated.

FIG. 8*b*, skew=0°: In this case, the planes of polarization between the satellite and the antenna are in perfect agreement (skew=0°). The satellite signal V is seen completely at the port V' by the antenna and is conducted directly to the port V. The quad-ridge polarizer is not being rotated.

Figure 8D:
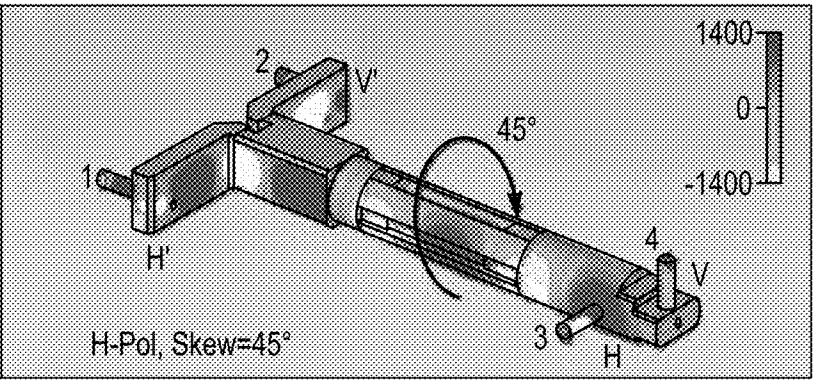
Figure 8C:
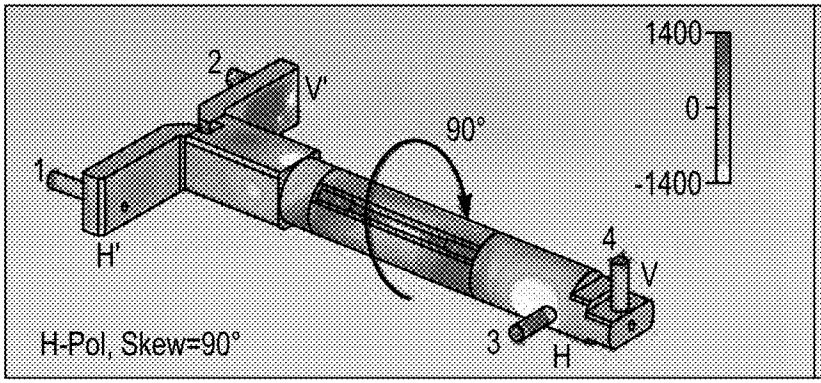

FIG. 8*c*, skew=90°: In this case, the planes of polarization between the satellite and the antenna are skewed by 90° (skew=90°). The satellite signal H is seen at the port V' by the antenna and is subsequently conducted back to the port H by the PCU by way of a 90° rotation of the quad-ridge polarizer.

FIG. 8*d*, skew=45°: In this case, the planes of polarization between the satellite and the antenna are skewed by 45° (skew=45°). The satellite signal H is seen in equal parts at the ports H' and V' of the antenna. A rotation of the quad-ridge polarizer by 45° makes the signal completely visible again at the port H.

LIST OF REFERENCE NUMERALS

1 PCU
2 first polarization converter, septum polarizer
3 second polarization converter, quad-ridge polarizer
4 outcoupling unit
5 incoupling unit
11 restrictions of the septum polarizer
12 restrictions of the quad-ridge polarizer
13 outcoupling elements
14 restrictions of the outcoupling unit
15 incoupling elements
16 tuning screw
A antenna field
R rotor
S satellite
V', H' antenna-side signals
V, H receiver-side signals
TE, LHCP, RHCP signal modes

What is claimed is:

1. A device for correcting a polarization shift of two linearly polarized signals, comprising:

a first polarization converter configured to convert the two linearly polarized signals from a linear polarization into a circular polarization, such that the signals are converted into two circularly polarized signals that rotate in opposite directions from one another; and a second polarization converter connected in series to the first polarization converter and configured to receive the circularly polarized signals, wherein the second polarization converter is configured to rotate about an axis to correct the polarization shift of the linearly polarized signals, the axis extending longitudinally through a center of the second polarization converter.

2. The device according to claim 1, wherein the first polarization converter is a septum polarizer.

3. The device according to claim 2, wherein the septum polarizer further includes a plurality of restrictions disposed linearly along the length of the septum polarizer, wherein the plurality of restrictions are configured to convert the two signals from the linear polarization into the circular polarization.

4. The device according to claim 3, wherein each of the plurality of restrictions has a stepped cross-section that progressively decreases in size along the length of the septum polarizer towards the second polarization converter.

5. The device according to claim 3, wherein the septum polarizer has a substantially rectangular cross-section, and the plurality of restrictions are disposed on a single internal wall of the septum polarizer.

6. The device according to claim 1, wherein the second polarization converter converts the two converted signals, received from the first polarization converter, from a circular polarization into a linear polarization.

7. The device according to claim 1, wherein the second polarization converter is a quad-ridge polarizer.

8. The device according to claim 7, wherein:

the quad-ridge polarizer includes a plurality of restrictions, such that restrictions on opposing walls are identical and restrictions on neighboring walls are different from each other.

9. The device according to claim 8, wherein the restrictions along the axis of the quad-ridge polarizer are symmetrical, wherein the axis extends longitudinally through a center of the second polarization converter.

10. The device according to claim 1, further comprising:

an outcoupling unit connected to the second polarization converter, wherein the outcoupling unit includes first and second outcoupling elements configured for outcoupling the signals into coaxial conductors, wherein:

the second polarization converter includes a plurality of restrictions rotated by 45 degrees in relation to the first and second outcoupling elements.

11. The device according to claim 10, wherein:

the first and second outcoupling elements are oriented perpendicularly to each other, and the outcoupling unit further includes one or more restrictions disposed between the first and second outcoupling elements for constricting the outcoupling unit.

12. The device according to claim 1, further comprising:

an incoupling unit connected to the first polarization converter including two conductors, each conductor including an incoupling element for converging the signals towards each other.

13. The device according to claim 12, wherein the incoupling unit further includes a tuning screw associated with each incoupling element, wherein the tuning screw is disposed on a wall proximate the associated incoupling element.

14. The device according to claim 1, wherein the device is configured to operate in a frequency range of 10.7 to 12.75 GHz or 13.75 to 14.5 GHz.

15. A dual channel polarization control unit for correcting the polarization shift of two linearly polarized signals, comprising:

a first polarization converter configured to convert the two linearly polarized signals from a linear polarization into a circular polarization, such that the signals are converted into two circularly polarized signals that rotate in opposite directions from one another; and a second polarization converter connected in series to the first polarization converter and configured to receive the circularly polarized signals, wherein the second polarization converter is configured to rotate about an axis to correct the polarization shift of the linearly polarized signals, the axis extending longitudinally through a center of the second polarization converter.

16. The control unit according to claim 15, wherein the second polarization converter converts the two converted signals, received from the first polarization converter, from the circular polarization into the linear polarization.

17. The control unit according to claim 15, wherein the first polarization converter is a septum polarizer, the septum polarizer further comprising:

a plurality of restrictions disposed linearly along the length of the septum polarizer, wherein the plurality of restrictions are configured to convert the two signals from the linear polarization into the circular polarization.

18. The control unit according to claim 17, wherein each of the plurality of restrictions has a stepped cross-section that progressively decreases in size along the length of the septum polarizer towards the second polarization converter.

19. The control unit according to claim 15, wherein the second polarization converter is a quad-ridge polarizer, the quad-ridge polarizer comprising:

a plurality of restrictions, such that restrictions on opposing walls are identical and restrictions on neighboring walls are different from each other.

20. The control unit according to claim 15, further comprising:

an outcoupling unit connected to the second polarization converter, wherein the outcoupling unit includes first and second outcoupling elements configured for outcoupling the signals into coaxial conductors, wherein:

the second polarization converter includes a plurality of restrictions rotated by 45 degrees in relation to the first and second outcoupling elements.

* * * * *